US011268336B2

(12) United States Patent
Hiorth et al.

(10) Patent No.: US 11,268,336 B2
(45) Date of Patent: Mar. 8, 2022

(54) WELL TOOL DEVICE COMPRISING A RATCHET SYSTEM

(71) Applicant: Interwell Norway AS, Hafrsfjord (NO)

(72) Inventors: Espen Hiorth, Trondheim (NO); Terje Stormo, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 8 days.

(21) Appl. No.: 16/647,387

(22) PCT Filed: Sep. 14, 2018

(86) PCT No.: PCT/EP2018/074924
§ 371 (c)(1),
(2) Date: Mar. 13, 2020

(87) PCT Pub. No.: WO2019/101387
PCT Pub. Date: May 31, 2019

(65) Prior Publication Data

US 2020/0270961 A1 Aug. 27, 2020

(30) Foreign Application Priority Data

Nov. 21, 2017 (NO) ..... 20171858

(51) Int. Cl.
*E21B 23/01* (2006.01)
*E21B 23/02* (2006.01)
*E21B 33/12* (2006.01)

(52) U.S. Cl.
CPC ..... *E21B 23/01* (2013.01); *E21B 23/02* (2013.01); *E21B 33/12* (2013.01)

(58) Field of Classification Search
CPC ..... E21B 23/01; E21B 23/02; E21B 33/12
See application file for complete search history.

(56) References Cited

U.S. PATENT DOCUMENTS 8,439,107 B2 * 5/2013 Xu ..... E21B 23/00 166/125
8,579,023 B1 11/2013 Nish et al.
(Continued)

FOREIGN PATENT DOCUMENTS

NO 20141476 A1 6/2016
WO 2006/095160 A1 9/2006
WO 2016/144314 A1 9/2016

OTHER PUBLICATIONS

International Search Report for corresponding International Application No. PCT/EP2018/074924, dated Jan. 2, 2019 (6 pages).
(Continued)

*Primary Examiner* — Frederick L Lagman
(74) *Attorney, Agent, or Firm* — Osha Bergman Watanabe & Burton LLP

(57) ABSTRACT

A well tool device includes a mandrel device having an axial center axis, a housing device provided radially outside of the mandrel device, and a ratchet system. The ratchet system includes a grooved outer surface area of the mandrel device, a first locking ring including a grooved inner surface area engaged with the grooved outer surface area of the mandrel device, a grooved outer surface area, and an axial slit allowing radial expansion of the first locking ring. The first locking ring is engaged with the outer housing. The ratchet system is configured to allowing relative axial movement between the mandrel device and the first locking ring in a first axial direction and to prevent relative axial movement between the mandrel device and the locking ring in a second direction opposite of the first direction. The ratchet system further includes a second locking ring provided radially outside the first locking ring, the second locking ring including a grooved inner surface area engaged with the grooved outer surface area of the first locking ring, and an axial slit
(Continued)

Figure 1A:
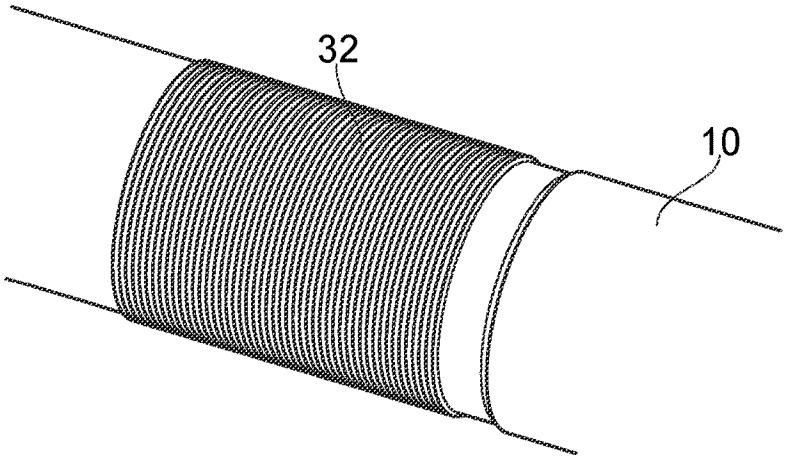
FIG. 1a (Prior Art)

allowing radial expansion of the second locking ring. The second locking ring is engaged with the outer housing.

9 Claims, 7 Drawing Sheets

(56) References Cited

U.S. PATENT DOCUMENTS

| | | | | |
|---|---|---|---|---|
| 8,887,818 | B1 * | 11/2014 | Carr | E21B 33/1293 166/387 |
| 10,590,732 | B2 * | 3/2020 | Ingram | E21B 33/12 |
| 2008/0251261 | A1 * | 10/2008 | Arce | E21B 33/04 166/387 |
| 2012/0012303 | A1 | 1/2012 | Xu | |
| 2013/0319772 | A1 * | 12/2013 | Bhatia | E21B 23/02 175/300 |
| 2016/0273290 | A1 * | 9/2016 | Harms | E21B 23/01 |
| 2019/0186232 | A1 * | 6/2019 | Ingram | E21B 33/128 |

OTHER PUBLICATIONS

Written Opinion for corresponding International Application No. PCT/EP2018/074924, dated Jan. 2, 2019 (6 pages).
International Preliminary Report on Patentabilitty for corresponding International Application No. PCT/EP2018/074924, dated Jan. 2, 2019 (12 pages).
Nowegian Search Report for corresponding Norwegian Application No. 20171858, dated Jun. 18, 2018 (2 pages).

* cited by examiner

WELL TOOL DEVICE COMPRISING A RATCHET SYSTEM

FIELD OF THE INVENTION

The present invention relates to a well tool device comprising a ratchet system.

BACKGROUND OF THE INVENTION

Some well tools for oil and/or gas wells comprises anchoring devices. Such a well tool is run into the well in a run or radially retracted state. At a desired location, the tool is brought to its set or radially retracted state, where the tool is fixed to the inner surface of the well pipe by means of its anchoring devices. Some of these tools are retrievable, i.e. they can be brought from the set state to a retrievable or radially retracted state again, to ease the retrieval of the tool out from the well.

Other well tools, such as bridge plugs, straddles etc., comprises an additional sealing element that is radially expanded towards the inner surface of the well to prevent axial fluid flow between the upper and lower sides of the sealing element.

The above well tools may be brought between their retracted and expanded states by means of a relative axial displacement between an inner mandrel device and an outer housing device of the well tool.

A ratchet system is often used in such tools. Such a prior art ratchet system 30 is shown in FIGS. 1*a*-1*d* and 2*a*-2*b* comprising a grooved outer surface area 32 provided on the outside of the mandrel device 10, a locking ring 40 and a grooved inner surface area 34 provided on the inside of the outer housing device 20.

The locking ring 40 comprises a grooved inner surface area 42 for engagement with the grooved outer surface area 32 of the mandrel device 10 and a grooved outer surface area 44 for engagement with the grooved inner surface area 34 of the outer housing 20.

Figure 2A:
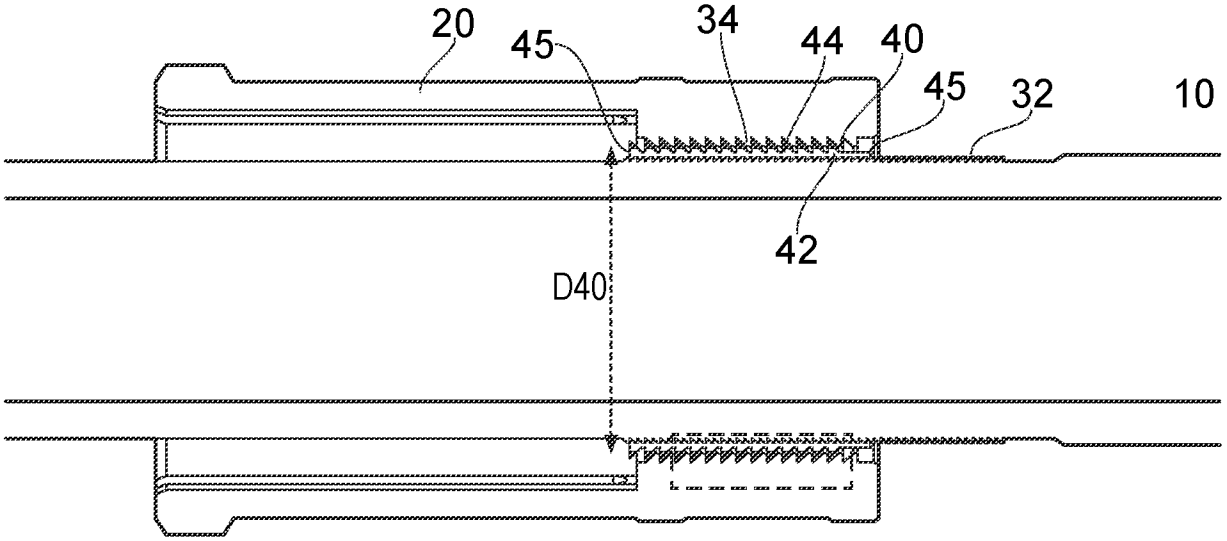
FIG. 2a (Prior Art)
Figure 2B:
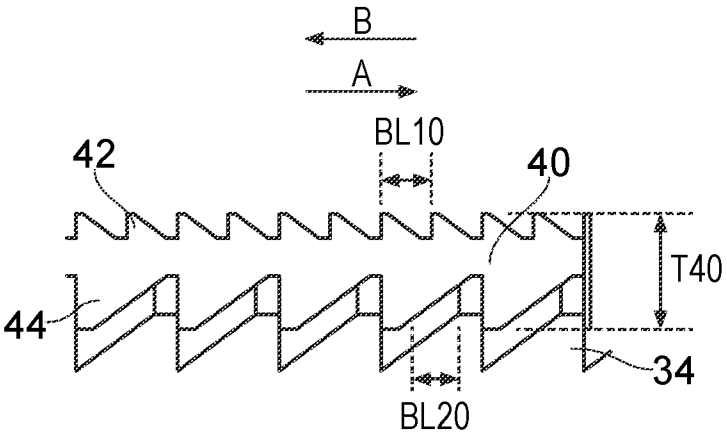
FIG. 2b (Prior Art)

Axial movement between the mandrel device 10 and the locking ring 40 is allowed in a first direction A when the locking ring 40 is engaged with the mandrel device 10 while movement between the mandrel device 10 and the locking ring 40 is prevented in a second direction B opposite of the first direction A (FIG. 2*b*). Hence, the ratchet system 30 may be considered as a locking mechanism for preventing relative axial movement between two parts in one direction only.

It should be noted that there is no relative axial movement between the outer housing 20 and the locking ring 40. The outer housing 20 and the locking ring 40 can not be fixed to each other, as the locking ring 40 must be allowed to radially expand as its grooved inner surface area 42 moves relative to the grooved outer surface area 32 in the allowed direction A. The locking ring 40 comprises an axial slit 41 to allow such radial expansion of the locking ring 40. To prevent relative axial movement between the outer housing 20 and the locking ring 40, the number of grooves per unit of length on the outer surface 44 of the locking ring 40 is typically half of the number of grooves per unit of length on the inner surface 42 of the locking ring.

The ratchet system is typically used to allow the tool to be brought from the retracted state to the expanded state while preventing the tool going from the expanded state and back to the retracted state again, as this will cause an undesired release of the tool with respect to the inner surface of the well pipe.

In NO 340816 and NO 20141476 (Interwell) a releasable ratchet system is described to have two states, a first state where the ratchet system is working as a normal ratchet system, i.e. that movement between the mandrel device and the locking ring is allowed in one direction only, and a second state where movement between the mandrel device and the locking ring is allowed in both directions.

Some prior art locking rings have a threaded or hatched outer surface for mechanical connection to the housing device of the tool. The purpose of the mechanical connection between the housing device and the locking ring is to allow the above-mentioned temporary small expansion of the diameter of the locking ring 10 within the housing.

One disadvantage with the above solution is that a small relative axial movement between the housing 20 and the locking ring 40 is inherently allowed due to the nature of such grooved connections. This backward movement is often referred to as backlash. In FIG. 2*b*, this backlash between the outer housing 20 and the locking ring 40 is indicated with arrow BL20.

There will often be a backlash between the locking ring 40 and the mandrel device 10. This backlash is indicated with arrow BL10 in FIG. 2*b*. The maximum backlash BL10 is indicated in FIG. 2*a*. Typically, the backlash BL10 will be smaller than the backlash BL20. Such backlash is undesired, as the well tool will loosen its engagement with the inner surface of the well pipe.

Typically, springs are used to prevent or reduce the above backlash. Such springs contributes to the length and complexity of the well tool.

Hence, one object of the invention is to reduce backlash of ratchet systems of well tools. Yet another object is to reduce the need of springs to prevent such backlash.

One solution to this problem could be to transfer forces between the outer housing 20 and the locking ring 40 via the axially facing, annular end surfaces 45 of the locking ring 40.

One disadvantage with this solution is that for higher pressures, a larger area for transferring axial forces between the outer housing and the locking ring 40 is needed. An increased area is only achieved by increasing the thickness T40 (FIG. 2*b* of the locking ring 40, as an increase of the diameter D40 (FIG. 2*a*) for the locking ring is not allowed due to the maximum diameter of the well pipe in which the tool is to be used. Any such increase in thickness causes the locking ring to be more rigid and less flexible. During the development of the present invention, such thicker locking rings were tested. During these tests, it was discovered that when the locking ring was pressed upwardly over the threads of the mandrel device, the locking ring became radially expanded. However, due to the rigidity of the locking ring, the locking ring did not radially retract as expected afterwards—the locking ring was plastic deformed, causing a reduced engagement between the outwardly facing threads of the mandrel device and the inwardly facing threads of the locking ring.

The above grooved surface areas can be provided as threads, i.e. as a spiral-shaped tracks. Here, the assembly of the ratchet system can be performed by screwing the different parts of the ratchet system together. Alternatively, the grooved surface areas can be provided as ring-shaped tracks. Here, the locking ring of the ratchet system must be radially expanded during the assembly. For the above locking ring with increased thickness, a powerful tool must be used to force the locking ring open during assembly. Again, there is a risk of plastic deformation of the locking ring.

In addition, it was found that during the setting of a plug with such a locking ring, a larger proportion of the available setting force will be used to move the ratchet system, causing a smaller proportion of the available setting force to compress the sealing element of the plug towards the inner surface of the well pipe, which negatively affects the pressure rating of the plug.

Hence, another object of the invention is to provide a well tool with a ratchet system which do not affect other parts of the well tool negatively.

As for many such well tools, the object is to provide well tools which can withstand higher temperatures and higher pressures.

SUMMARY OF THE INVENTION

The present invention relates to a well tool device comprising:

a mandrel device having a axial center axis;

an housing device provided radially outside of the mandrel device;

a ratchet system comprising:

an grooved outer surface area of the mandrel device;

a first locking ring comprising a grooved inner surface area engaged with the grooved outer surface area of the mandrel device, a grooved outer surface area and an axial slit allowing radial expansion of the first locking ring, where the first locking ring is engaged with the outer housing;

where the ratchet system is configured to allowing relative axial movement between the mandrel device and the first locking ring in a first axial direction and to prevent relative axial movement between the mandrel device and the locking ring in a second direction opposite of the first direction;

characterized in that the ratchet system further comprises:

a second locking ring provided radially outside the first locking ring, the second locking ring comprising a grooved inner surface area engaged with the grooved outer surface area of the first locking ring, and an axial slit allowing radial expansion of the second locking ring, where the second locking ring is engaged with the outer housing.

In one aspect, the grooved inner and outer surface areas of the first and second locking rings are preventing relative axial movement between the first and second locking rings.

In the case that the grooved inner and outer surface areas comprises ring-shaped tracks, no relative axial movement will occur between the first and second locking rings. However, in the case that the grooved inner and outer surface areas comprise spiral-shaped tracks, a small relative axial movement may occur between the first and second locking rings during the radial expansion of the locking rings, i.e. during the relative axial movement between the locking ring and the mandrel device in the first axial direction.

In one aspect, the grooved inner and outer surface areas of the first and second locking rings are allowing relative circumferential movement between the first and second locking rings.

This is achieved by orienting the tracks of the grooved inner and outer surface areas perpendicular to the longitudinal axis I or substantially perpendicular to the longitudinal axis I.

In one aspect, the ratchet system comprises:

a first element protruding inwardly from the inside of the housing device;

a second element protruding inwardly from the inside of the housing device at an axial distance from the first element;

where the first and second locking rings are provided axially between the first and second elements;

where the first inwardly protruding element comprises a first supporting surface for transferring axial forces between the housing device and lower end surfaces of the first and second locking rings;

where the second inwardly protruding element comprises a second supporting surface for transferring axial forces between the housing device and the upper end surfaces of the first and second locking rings.

Alternatively, the first and second elements may be provided as a part of the housing device alternatively they can be fixed to or connected to the housing device. Preferably, the first and second elements are ring elements to provide as large as possible contact surfaces with respect to the locking rings.

In one aspect, an axial length of the first locking ring is equal to an axial length of the second locking ring.

In one aspect, the axial distance is equal to the axial length of the first and/or second locking ring.

Alternatively, the axial distance can be equal to the axial length of the first and/or second locking ring plus an additional length to ensure that the elements do not prevent radial expansion of the locking rings due to friction between the locking rings and the elements. The additional length is shorter than the distance between the tracks of the grooved inner and outer surface area of the locking ring and mandrel device. Hence, this additional length does not contribute to an increased backlash for the well tool.

In one aspect, the ratchet system comprises an annulus provided radially between the outer surface of the inner mandrel device and the inner surface of the outer housing device and axially between the first and second elements.

The diameter of the annulus is larger than the outer diameter of the outer locking ring in its initial state, thereby allowing radial expansion of the locking rings.

In one aspect, the slits of the first and second locking rings are initially aligned with each other.

In one aspect, the ratchet system further comprises a third locking ring provided radially outside the second locking ring, the second locking ring comprising a grooved outer surface area, the third locking ring comprising a grooved inner surface area engaged with the grooved outer surface area of the second locking ring, and an axial slit allowing radial expansion of the third locking ring, where the third locking ring is engaged with the outer housing.

Of course, when this third locking ring is the outer locking ring, the diameter of the annulus is larger than the outer diameter of the third locking ring in its initial state. In one aspect, the thickness of the second locking ring is larger than the thickness of the first locking ring.

The above well tool device has a longitudinal center axis, where the well tool device is inserted axially into an oil and/or gas well, i.e. with its longitudinal center axis in a direction parallel to or coinciding with, the central axis of the well. The term "upper" refers to a part of the well tool device being relatively closer to the top end of the well, while the term "lower" refers to a part of the well tool device being relatively closer to the bottom end of the well. In the present drawings, the left side of the drawings are considered to be the upper side, while the right side of the drawings are considered to be the lower side.

The terms "outer", "outside", "outwardly" refers to a part of the well tool device being faced away from the longitudinal center axis, while the terms "inner", "inside" or "inwardly" refers to a part of the well tool device being faced towards the longitudinal center axis.

According to the invention, it is achieved that the relative axial displacement between the housing device and the locking device is reduced. There will still be relative axial displacement between the mandrel device and the locking device. However, the relative axial displacement between the housing device and the locking device in prior art was considerably larger (i.e. typically twice as large) than the relative axial displacement between the mandrel device and the locking device and hence the total axial displacement between the mandrel device and the housing device is reduced.

The Interwell ECJ tool (Expandable Junk Catcher) is sold and marketed by Interwell. This tool comprises an expandable junk guiding device (described in NO 20121377) and an anchoring device which are radially expanded towards the inner surface of the well pipe to hold the tool at the desired location in the well. A prior art ratchet system has been used in this tool to lock the housing device to the mandrel device in the radially expanded state. However, due to the relative axial displacement allowed by the prior art ratchet system, a spring device was needed in the tool to prevent or at least reduce the relative axial displacement. By replacing the prior art ratchet system with the ratchet system of the present invention, the spring device can be replaced by a relatively smaller spring device, which contributes to a lower cost and shorter length of the tool.

DETAILED DESCRIPTION

Figure 1B:
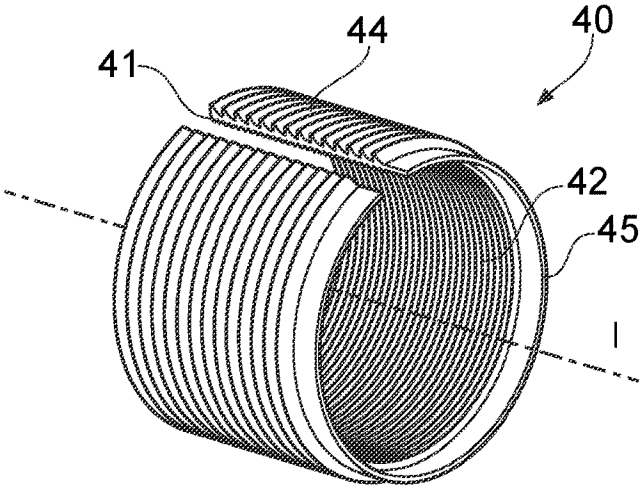
FIG. 1b (Prior Art)
Figure 1C:
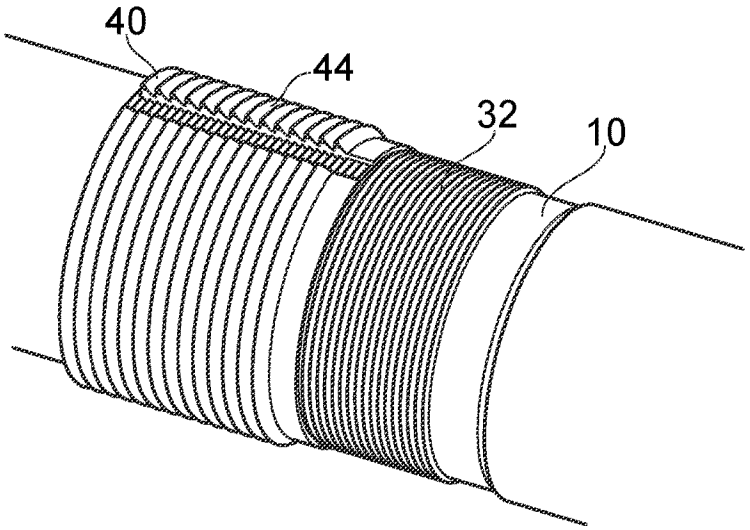
FIG. 1c (Prior Art)
Figure 1D:
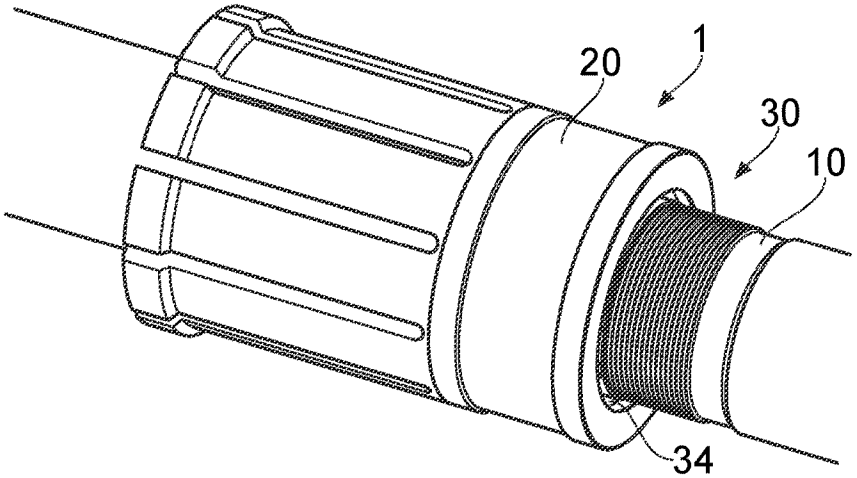

Embodiments of the invention will now be described with reference to the enclosed drawings, where:

FIG. 1*a* illustrates a perspective view of a prior art mandrel device;

FIG. 1*b* illustrates a perspective view of a prior art locking ring;

FIG. 1*c* illustrates a perspective view of the prior art locking ring engaged with the prior art mandrel device;

FIG. 1*d* illustrates a perspective view of a prior art outer housing device engaged with the locking ring, i.e. all parts of the ratchet system of the well tool has been assembled;

FIG. 2*a* illustrates a cross sectional side view of FIG. 1*d;*

FIG. 2*b* illustrates an enlarged view of the dashed box of FIG. 2*a;*

Figure 3A:
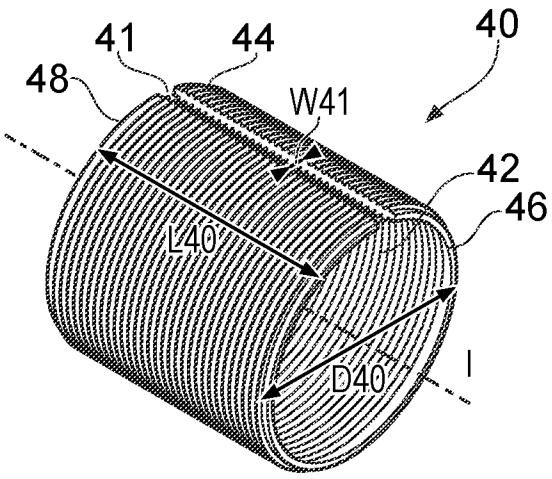
Figure 3B:
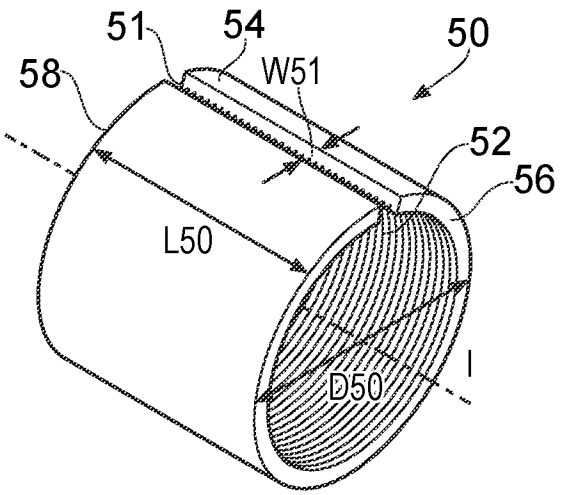
Figure 3C:
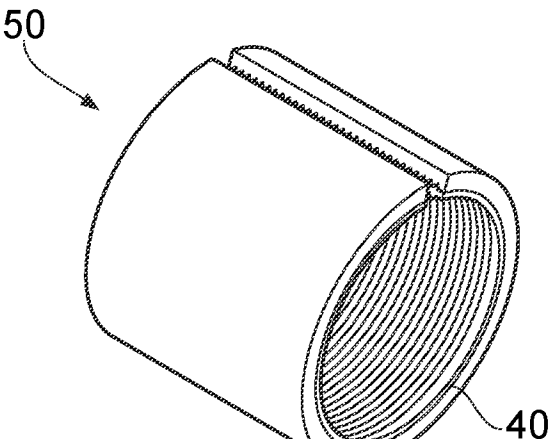
Figure 3D:
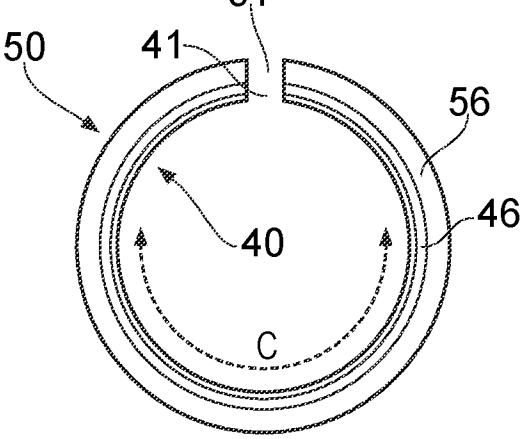

FIG. 3*a* illustrates a perspective view of first locking ring of the ratchet system;

FIG. 3*b* illustrates a perspective view of second locking ring of the ratchet system;

FIG. 3*c* illustrates a perspective view of the first and second locking ring engaged with each other;

FIG. 3*d* illustrates a front view of FIG. 3*c;*

Figure 4A:
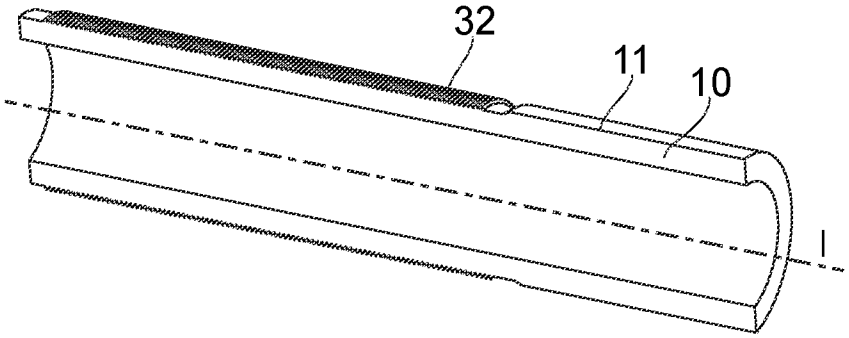
Figure 4B:
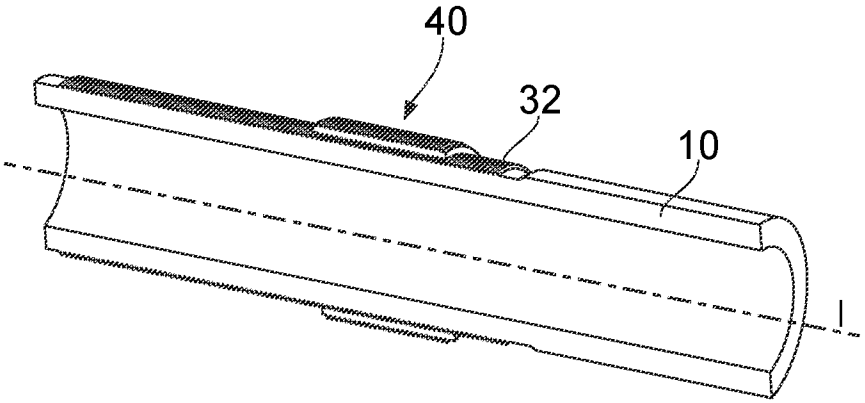

FIG. 4 *a* illustrates a cross sectional perspective view of the mandrel device with the grooved outer surface area of the ratchet system;

FIG. 4*b* illustrates the first locking ring engaged with the mandrel device of FIG. 1*a;*

Figure 4C:
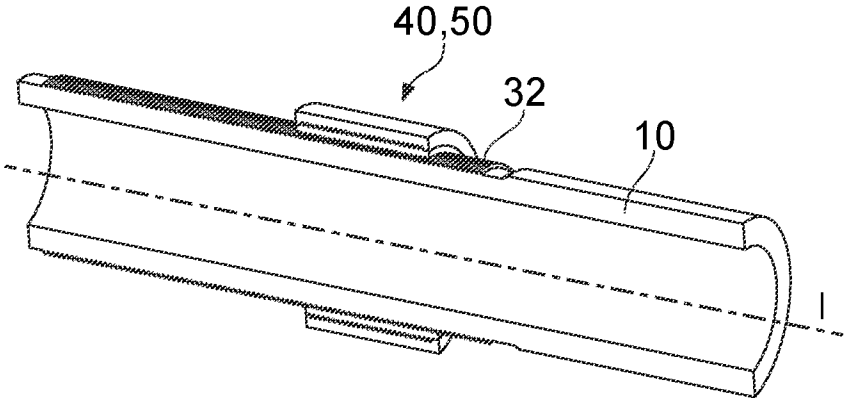

FIG. 4*c* illustrates the second locking ring engaged with the first locking ring of FIG. 4*b;*

Figure 4D:
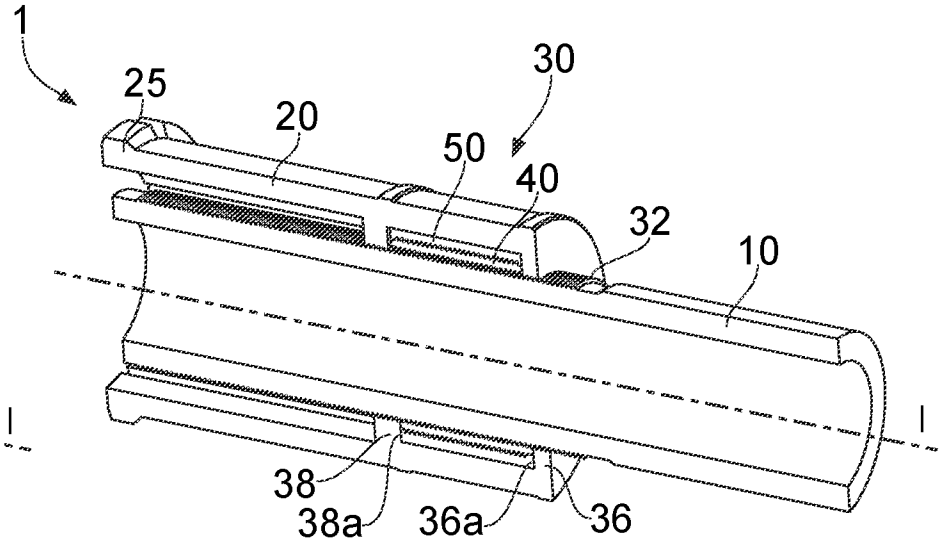
Figure 5A:
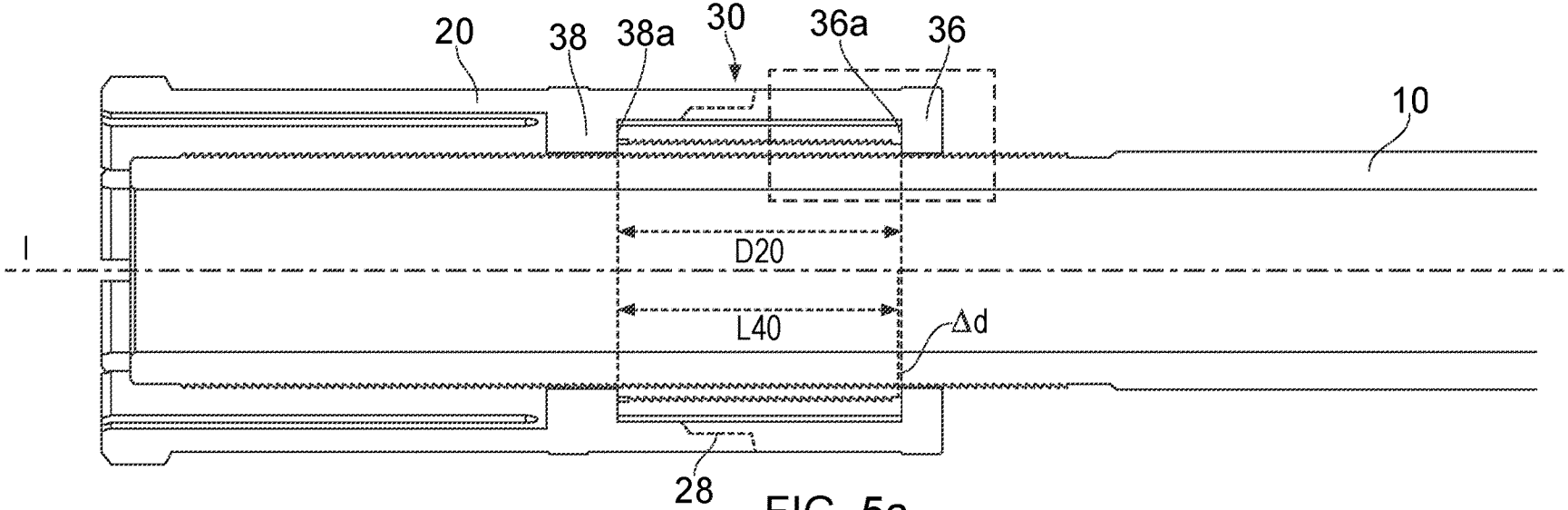

FIG. 4*d* illustrates outer housing engaged with the first and second locking ring;

FIG. 5*a* illustrates a cross sectional side view of FIG. 4*d;*

Figure 5B:
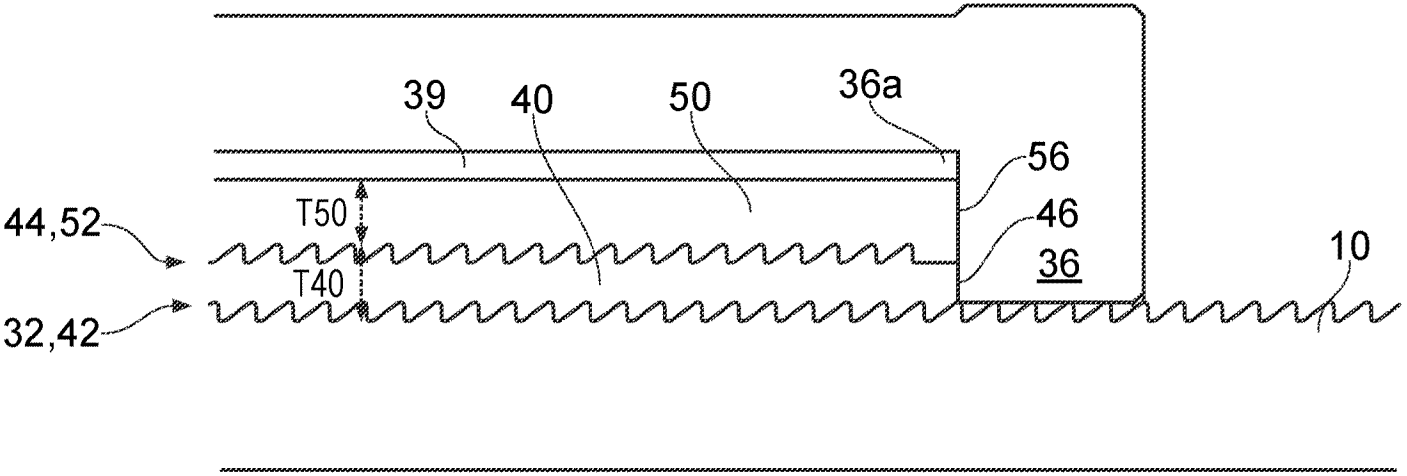

FIG. 5*b* illustrates an enlarged view of the dashed box of FIG. 5*a;*

Figure 6B:
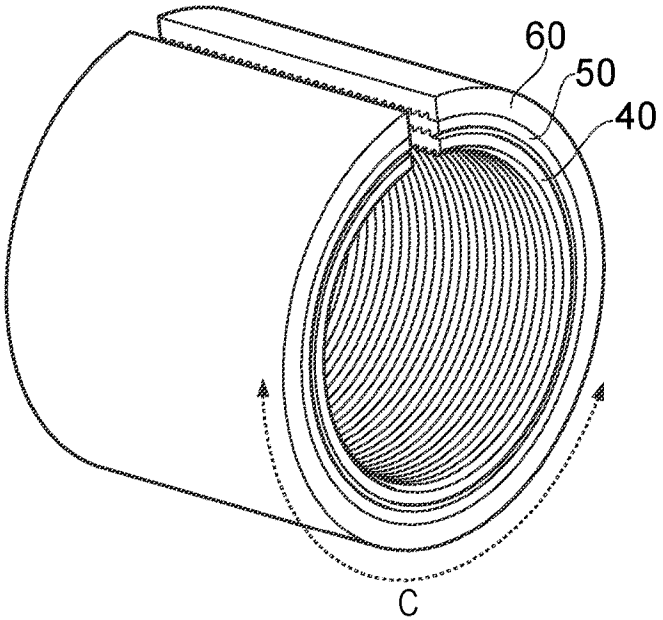
Figure 6A:
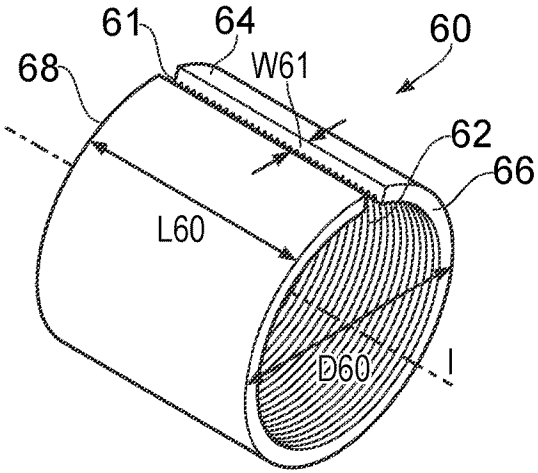
Figure 6C:
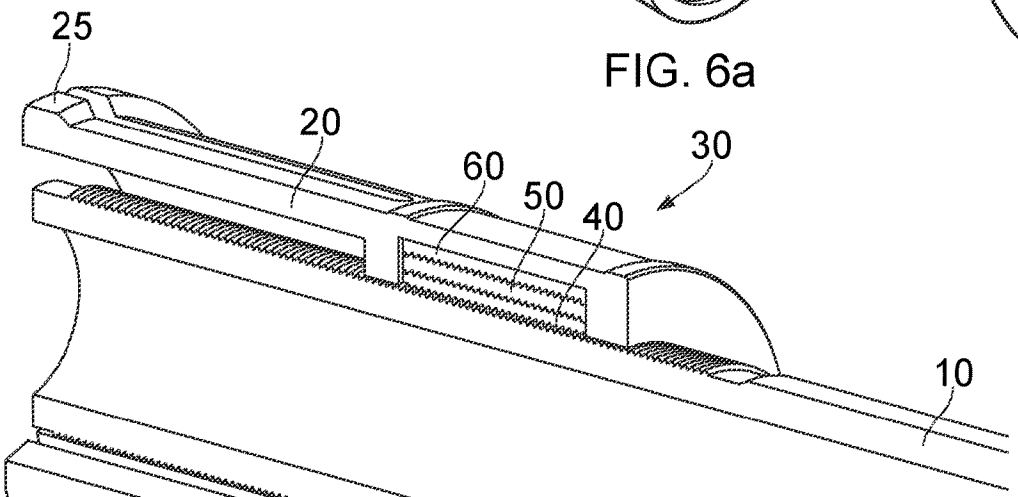
Figure 6C:
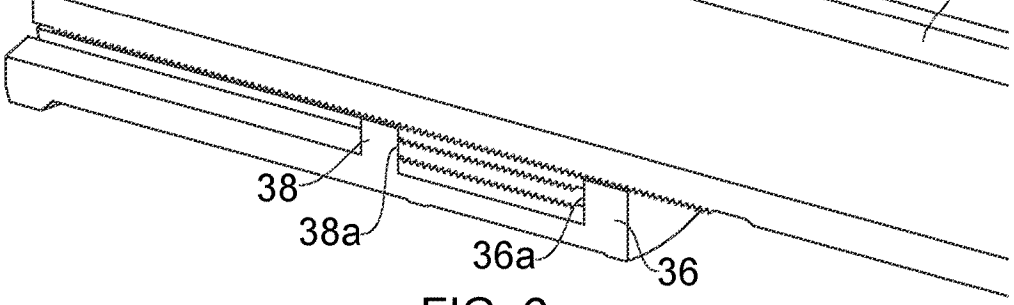

FIG. 6*a* illustrates a perspective view of a third locking ring;

FIG. 6*b* illustrates the first, second and third locking rings engaged with each other;

FIG. 6*c* illustrates a cross sectional perspective view of a ratchet system with the locking rings of FIG. 6*b:*

Figure 7A:
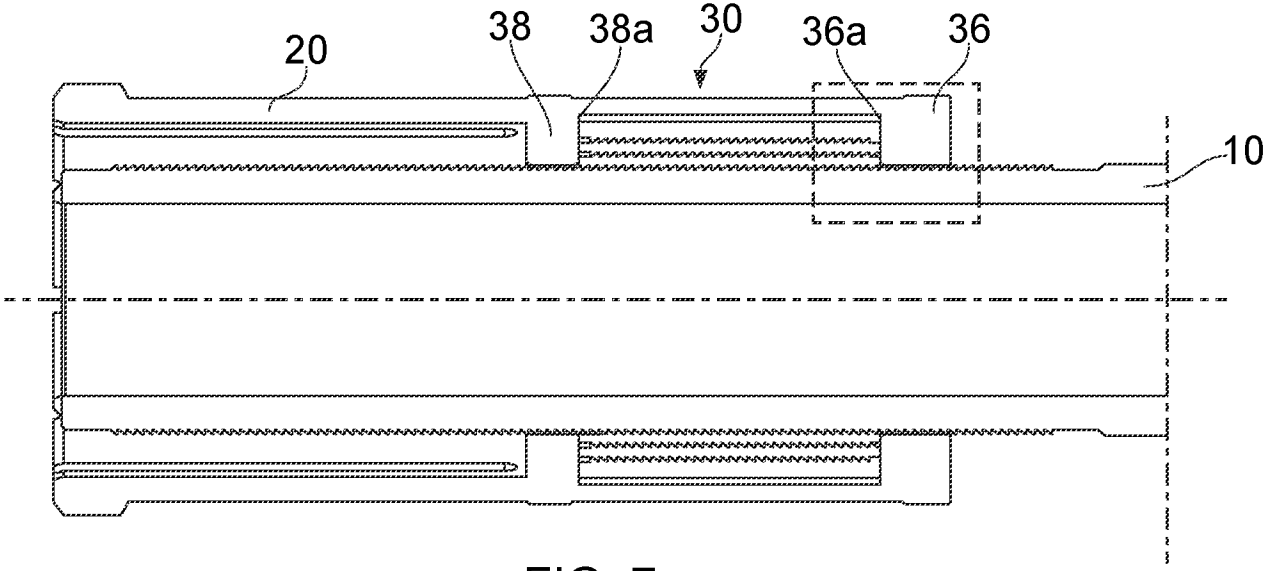

FIG. 7*a* illustrates a cross sectional side view of FIG. 6*d;*

Figure 7B:
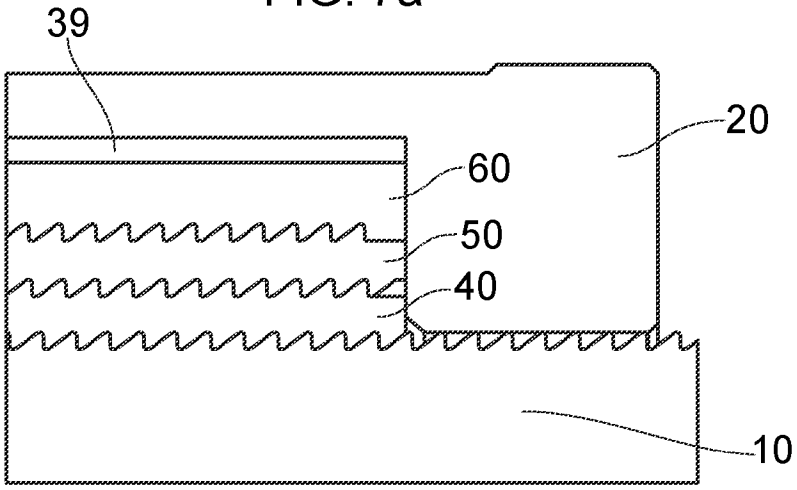

FIG. 7*b* illustrates an enlarged view of the dashed box of FIG. 7*a;*

It is now referred to FIG. 4*d*, where a well tool 1 according to the present invention is shown. The well tool 1 comprises a mandrel device 10 having an axial center axis I and a housing device 20 provided radially outside of the mandrel device 10. A ratchet system 30 is connected between the mandrel device 10 and the outer housing device 20. As in prior art, the mandrel device 10 comprises a grooved outer surface area 32 being defined as a part of the ratchet system 30.

It should be noted that the well tool 1 here is only a part of a well tool used to illustrate the technical features of the ratchet system 30. The mandrel device and the outer housing device are considered known for a skilled person and will not be described here in detail. It should however be noted that the mandrel device 10, the outer housing device 20 and the ratchet system 30 can be implemented into several of the present Interwell well tools, such as the expandable junk catching device (described in NO 20121377), the high expansion plug (described in U.S. Pat. No. 7,178,602) etc.

In FIG. 4*d*, it is shown that the outer housing device 20 comprises finger connectors 25 for connection to other parts (not shown) of the well tool 1.

It is now referred to FIG. 3*a*. Here, a first locking ring 40 of the ratchet system 30 is shown. The first locking ring 40 comprises an axial slit 41, a grooved inner surface area 42 facing towards its center axis I and a grooved outer surface area 44 facing away from the center axis I. The first locking ring 40 has a length L40.

A first annular end surface is indicated with reference number 46 while a second annular end surface, provided on the opposite side of the first end surface 46, is indicated with reference number 48. The first and second end surfaces 46, 48 are preferably perpendicular to the longitudinal center axis I.

It is now referred to FIG. 3*b*. Here a second locking ring 50 of the ratchet system 30 is shown. The second locking ring 50 comprises an axial slit 51, a grooved inner surface area 52 facing towards its center axis I and an outer surface area 54 facing away from the center axis I. In the present embodiment, the outer surface area 54 is smooth. The second locking ring 50 has a length L50 preferably equal to the length L40 of the first locking ring 40.

A first annular end surface is indicated with reference number 56 while a second annular end surface, provided on the opposite side of the first end surface 56, is indicated with reference number 58. The first and second end surfaces 56, 58 are preferably perpendicular to the longitudinal center axis I.

The diameter of the first locking ring 40 is smaller than the diameter of the second locking ring 50, as is apparent from FIGS. 3*c* and 3*d*. Here, the first and second locking rings 40, 50 have been assembled into one larger unit, where the grooved inner surface area 52 of the second locking ring 50 has been engaged with the grooved outer surface area 44 of the first locking ring 40.

As shown in FIGS. 3*c* and 3*d*, the slits 41, 52 of the first and second locking rings 40, 50 are aligned with each other.

The assembly of the well tool 1 and ratchet system 30 is shown in FIG. 4*a-d*.

It FIG. 4*a*, it is shown that the ratchet system 30 comprises a grooved outer surface area 32 provided on an outer surface 11 of the mandrel device 10.

In FIG. 4*b*, the first locking ring 40 is provided radially outside of the mandrel device 10, with the grooved inner surface area 42 engaged with the grooved outer surface area 32 of the mandrel device 10.

In FIG. 4*c*, the second locking ring 40 is provided radially outside of the first locking ring 40, with the grooved inner surface area 52 of the second locking ring 50 engaged with the grooved outer surface area 42 of the first locking ring 40. Of course, it is possible to first assemble the first and second rings 40, 50 and then assemble these rings onto the mandrel device 10.

It is now referred to FIG. 4*d*, FIG. 5*a* and FIG. 5*b*. Here, it is shown how the first and second locking rings 40, 50 are engaged with the outer housing 20.

The ratchet system 30 comprises a first, inwardly protruding ring element 36 and a second inwardly protruding ring element 38 provided at an axial distance D20 from the first element 36. These ring elements 36, 38 are defining a compartment indicated as reference number 39 in FIG. 5*a*. Hence, the locking rings 40, 50, when they are in this compartment 39, are provided radially between the outer surface of the mandrel device 10 and the inner surface of the outer housing 20 and axially between the first and second ring elements 36, 38. As shown in FIG. 5*b*, the compartment 39 has sufficient available radial space to allow sufficient radial expansion of the locking rings 40, 50.

In the present embodiment, the ring elements 36, 38 are provided as parts of the outer housing 20 itself. However, these elements 36, 38 may alternatively be connected to or fixed to the housing 20. To ease the assembly of the well tool 1, the elements 36, 38 may be provided as part of two different housing sections of the outer housing 20, where the two different housing sections are connected by a threaded connection indicated by a dashed line 28 in FIG. 5*a*.

The first inwardly protruding element 36 comprises a first supporting surface 36*a* for transferring axial forces between the housing device 20 and lower end surfaces 46, 56 of the first and second locking rings 40, 50. The second inwardly protruding element 38 comprises a second supporting surface 38*a* for transferring axial forces between the housing device 20 and the upper end surfaces 48, 58 of the first and second locking rings 40, 50.

The axial distance D20 between the ring elements 36, 38, i.e. between the supporting surfaces 36*a*, 38*a*, is indicated in FIG. 5*a*. This axial distance D20 can be equal to the axial length L40, L50 of the first and/or second locking ring 40, 50 plus an additional length Δd to ensure that the elements 36, 38 do not prevent radial expansion of the locking rings 40, 50 due to friction between the locking rings and the elements. The additional length Δd is shorter than the distance between the tracks of the grooved inner and outer surface area of the locking ring 40 and mandrel device 10 and will preferably be less than 1 mm. Hence, this additional length Δd does not contribute to an increased backlash for the well tool.

Hence, there is no grooved interface (i.e. with spiral-shaped or ring-shaped tracks) for transferring axial forces between the outer housing and the locking ring. Consequently, the prior art backlash BL20 of FIG. 2*b* is avoided.

The thickness T50 of the second locking ring 50 is preferably larger than the thickness T40 of the first locking ring 40.

It is now referred to FIGS. 6*a*, 6*b* and 6*c* and FIGS. 7*a* and 7*b*. Here, an alternative embodiment is shown, where the ratchet system 30 comprises three locking rings. Here, the second locking ring 50 is similar to the above embodiment, however, the outer surface 54 is now a grooved outer surface area.

It is now referred to FIG. 6*a*. Here a third locking ring 60 of the ratchet system 30 is shown. The third locking ring 60 comprises an axial slit 61, a grooved inner surface area 62 facing towards its center axis I and an outer surface area 64 facing away from the center axis I. In the present embodiment, the outer surface area 64 is smooth. The third locking ring 60 has a length L60 preferably equal to the length L40 of the first locking ring 40 and the length L50 of the second locking ring 50.

A first annular end surface is indicated with reference number 66 while a second annular end surface, provided on the opposite side of the first end surface 66, is indicated with reference number 68. The first and second end surfaces 66, 68 are preferably perpendicular to the longitudinal center axis I.

The diameter of the third locking ring 60 is larger than the diameter of the second locking ring 50, as is apparent from FIG. 6*b*.

The third locking ring 60 is provided radially outside the second locking ring 50, with the its grooved inner surface area 62 engaged with the grooved outer surface area 54 of the second locking ring 50. Also the third locking ring 60 is engaged with the outer housing 20 as shown in FIG. 6*c*.

It should be noted that it is possible to provide the ratchet system 30 with more than three locking rings as well.

The operation of the well tool 1 will now be described. As prior art ratchet systems, the ratchet system 30 is configured to allow relative axial movement between the mandrel device 10 and the first locking ring 40 in a first axial direction A and to prevent relative axial movement between the mandrel device 10 and the locking ring 40 in a second direction B opposite of the first direction A. This is achieved by the shape of the tracks of the grooved areas.

It should be noted that the above grooved inner and outer surface areas can comprise ring-shaped tracks or spiral-shaped tracks. It should also be noted that the tracks do not need to be continuous, there might be some areas of the inner and outer surface areas that are provided without tracks. For example, NO 20141476 describes a ratchet system where the locking ring comprises a guiding fin. It should also be noted that the ratchet system 30 may comprise a key for radially expanding the slit of the locking rings 40, 50, 60 mechanically, causing the ratchet system 30 to be in a released state, in which axial movement of the locking rings is allowed in both directions A and B. This is also known from NO 20141476 and NO 340816.

The above first, second and third locking rings 40, 50, 60 have an initial state which are shown in the drawings. The initial state is their state when they are not affected by external forces. As the first locking ring 40 moves over the first track of the grooved outer surface area 32 of the mandrel device 10, the first locking ring 40 will be radially expanded, causing the width W41 of the gap 41 to expand and hence also the diameter D40 to expand. The radial expansion of the first locking ring 40 will press the second locking ring 50 outwardly, thereby causing the width W51 of the gap 51 to expand and hence also the diameter D50 to expand. In the embodiment with three locking rings, the radial expansion of the second locking ring 50 will press the third locking ring 60 outwardly, thereby causing the width W61 of the gap 61 to expand and hence also the diameter D60 to expand. When the first locking ring 40 has moved over the first track, the locking rings will be radially retracted again.

The grooved inner and outer surface areas 44, 52 of the first and second locking rings 40, 50 are preventing relative axial movement between the first and second locking rings 40, 50. In the embodiment with three locking rings, the grooved inner and outer surface areas 54, 62 of the second and third locking rings 50, 60 are preventing relative axial movement between the second and third locking rings 50, 60.

However, it is possible that there will be a minor relative axial movement will occur between the locking rings as they are radially expanded and then radially retracted again as the first locking ring moves over the tracks of the mandrel device. However, such minor relative axial movement will in the above embodiments be limited by the ring elements 36, 38.

It should however be noted that the grooved outer and inner surface areas 44, 52 of the first and second locking rings 40, 50 are allowing relative circumferential movement indicated as arrow C in FIG. 3*d* between the first and second locking rings 40, 50. In the embodiment with three locking rings, also the grooved outer and inner surface areas 54, 62 of the second and third locking rings 50, 60 are allowing relative circumferential movement indicated as arrow C in FIG. 6*b* between the second and third locking rings 50, 60.

According to the invention, it is achieved that the relatively larger forces can be transferred between the locking rings and the housing device 20 due to the relatively larger contact area provided by the surface 36*a* and the sum of the respective annular end areas 46, 56, 66 of the locking rings in one direction and the corresponding contact area provided by the surface 38*a* and the sum of the respective annular end areas 48, 58, 68 of the locking rings in the opposite direction. During tests of a well tool comprising the above ratchet system, this solution was found superior to a ratchet system with one locking ring with increased thickness.

As indicated in FIG. 7*b*, there are no backlash between the locking rings 60, 50, 40. There is a relatively small backlash between the mandrel device and the first locking ring 40 which corresponds to the backlash B 10 in prior art, which typically is 0-2 mm. The relative axial displacement between the housing device and the locking device is smaller than this backlash B 10, and hence the total axial displacement between the mandrel device and the housing device is reduced.

The invention claimed is:

1. Well tool device comprising:

a mandrel device having an axial center axis;

a housing device provided radially outside of the mandrel device;

a ratchet system comprising:

a grooved outer surface area of the mandrel device;

a first locking ring comprising a grooved inner surface area engaged with the grooved outer surface area of the mandrel device, a grooved outer surface area, and an axial slit allowing radial expansion of the first locking ring, wherein the first locking ring is engaged with the outer housing;

wherein the ratchet system is configured to allow relative axial movement between the mandrel device and the first locking ring in a first axial direction and to prevent relative axial movement between the mandrel device and the locking ring in a second direction opposite of the first direction;

a second locking ring provided radially outside the first locking ring, the second locking ring comprising a grooved inner surface area engaged with the grooved outer surface area of the first locking ring, and an axial slit allowing radial expansion of the second locking ring, wherein the second locking ring is engaged with the outer housing;

a first element protruding inwardly from the inside of the housing device; and a second element protruding inwardly from the inside of the housing device at an axial distance from the first element;

wherein the first and second locking rings are provided axially between the first and second elements;

wherein the first inwardly protruding element comprises a first supporting surface for transferring axial forces between the housing device and lower end surfaces of the first and second locking rings; and wherein the second inwardly protruding element comprises a second supporting surface for transferring axial forces between the housing device and the upper end surfaces of the first and second locking rings.

2. Well tool device according to claim 1, where the grooved inner and outer surface areas of the first and second locking rings are preventing relative axial movement between the first and second locking rings.

3. Well tool device according to claim 1, where the grooved inner and outer surface areas of the first and second locking rings are allowing relative circumferential movement between the first and second locking rings.

4. Well tool device according to claim 1, wherein an axial length of the first locking ring is equal to an axial length of the second locking ring.

5. Well tool device according to claim 1, wherein the axial distance is equal to the axial length of the first and/or second locking ring.

6. Well tool device according to claim 1, wherein the ratchet system comprises an annulus provided radially between the outer surface of the inner mandrel device and the inner surface of the outer housing device and axially between the first and second elements.

7. Well tool device according to claim 1, wherein the slits of the first and second locking rings are initially aligned with each other.

8. Well tool device according to claim 1, wherein the ratchet system further comprises:

a third locking ring provided radially outside the second locking ring, the second locking ring comprising a grooved outer surface area, the third locking ring comprising a grooved inner surface area engaged with the grooved outer surface area of the second locking ring, and an axial slit allowing radial expansion of the third locking ring, wherein the third locking ring is engaged with the outer housing.

9. Well tool device according to claim 1, wherein the thickness of the second locking ring is larger than the thickness of the first locking ring.

* * * * *